US005579821A

United States Patent [19]

Vander Jagt

[11] Patent Number: 5,579,821

[45] Date of Patent: Dec. 3, 1996

[54] THERMALLY EFFICIENT PORTABLE MELTING FURNACE

[76] Inventor: Adrian D. Vander Jagt, 317 Birney St., Essexville, Mich. 48732

[21] Appl. No.: 393,466

[22] Filed: Feb. 27, 1995

[51] Int. Cl.[6] ..... B22D 41/00

[52] U.S. Cl. ..... 164/76.1; 164/335; 164/270.1

[58] Field of Search ..... 164/335, 76.1, 164/270.1, 336, 337; 266/242, 275, 276

[56] References Cited

U.S. PATENT DOCUMENTS 4,149,705 4/1979 Caudill ..... 266/275

FOREIGN PATENT DOCUMENTS 353043A 2/1987 Germany ..... 164/335

62-62181 3/1987 Japan ..... 266/242

*Primary Examiner*—Jack W. Lavinder

*Assistant Examiner*—I. H. Lin

*Attorney, Agent, or Firm*—Edward E. Schilling

[57] ABSTRACT

Apparatus is provided that includes a portable plural-walled ladle, a retractable immersion heating element, and support means for the heating element capable of controllably lowering the heating element so as to extend the heating element a preselected depth into the ladle, supporting the heating element during melting operations, and raising the heating element out of the ladle.

6 Claims, 3 Drawing Sheets

THERMALLY EFFICIENT PORTABLE MELTING FURNACE

FIELD OF THE INVENTION

The invention relates to a portable melting furnace assembly for the melting of non-ferrous metals in preparation for subsequent casting directly therefrom and to a method of carrying out such melting and also to casting thereafter.

BACKGROUND OF THE INVENTION

Portable melting furnaces or crucibles for non-ferrous metals have been made and used heretofore but uniformly suffer disadvantages from high energy losses wherein the heating elements, such as resistance heaters or induction heaters or other heat source are externally located to the ladle and from the resulting bulkiness and fragility of construction which tends to make the furnace subject to damage upon being bumped during handling, e.g., during casting. Melting has also been carried out using gas burners directed at the metal, but this results in unwanted oxidation of the metal at the surface of the resulting melt. Drawing melt from a stationary crucible into a portable ladle presents other problems of safety, contamination of the molten metal, difficulties in maintaining a consistent melt temperature, and large energy losses.

SUMMARY OF THE INVENTION

In a first aspect the invention is directed to a portable melting furnace assembly for melting a non-ferrous metal which includes, in combination, an insulated portable ladle, an immersion heater, and means for lowering the immersion heater into the ladle and supporting the immersion heater while it extends into the ladle, e.g., during melting operations, and raising the immersion heater out of the ladle. The support means may include provisions for swinging the raised immersion heater away from the portable ladle. An electric power source is connected to the immersion heater. Preferably a removable protective insulative cover is place over the ladle during melting operations and a protective gas atmosphere is provided over the melting metal, and under the insulative cover, if provided.

In a second aspect the invention is directed to a method of melting a non-ferrous metal in which the metal to be melted is added to an insulated portable ladle having an immersion heater extending thereinto and supported by support means controllable to raise and lower the heating element. Sufficient heat is then applied by means of the immersion heater to melt the metal in the ladle. The method further contemplates the steps of raising the immersion heater out of the molten metal and transporting the ladle to molds for casting. If the ladle is being transported by a fork truck the immersion heater is raised enough to permit lifting the ladle sufficiently to move it with the lift fork. If the ladle is being moved by an overhead assembly or crane, the method contemplates swinging the raised immersion heater out of the way so that the ladle may be elevated and moved, e.g., along a track, or by means of a crane, to the molds for casting the molten metal.

BRIEF DESCRIPTION OF THE INVENTION

Figure 1:
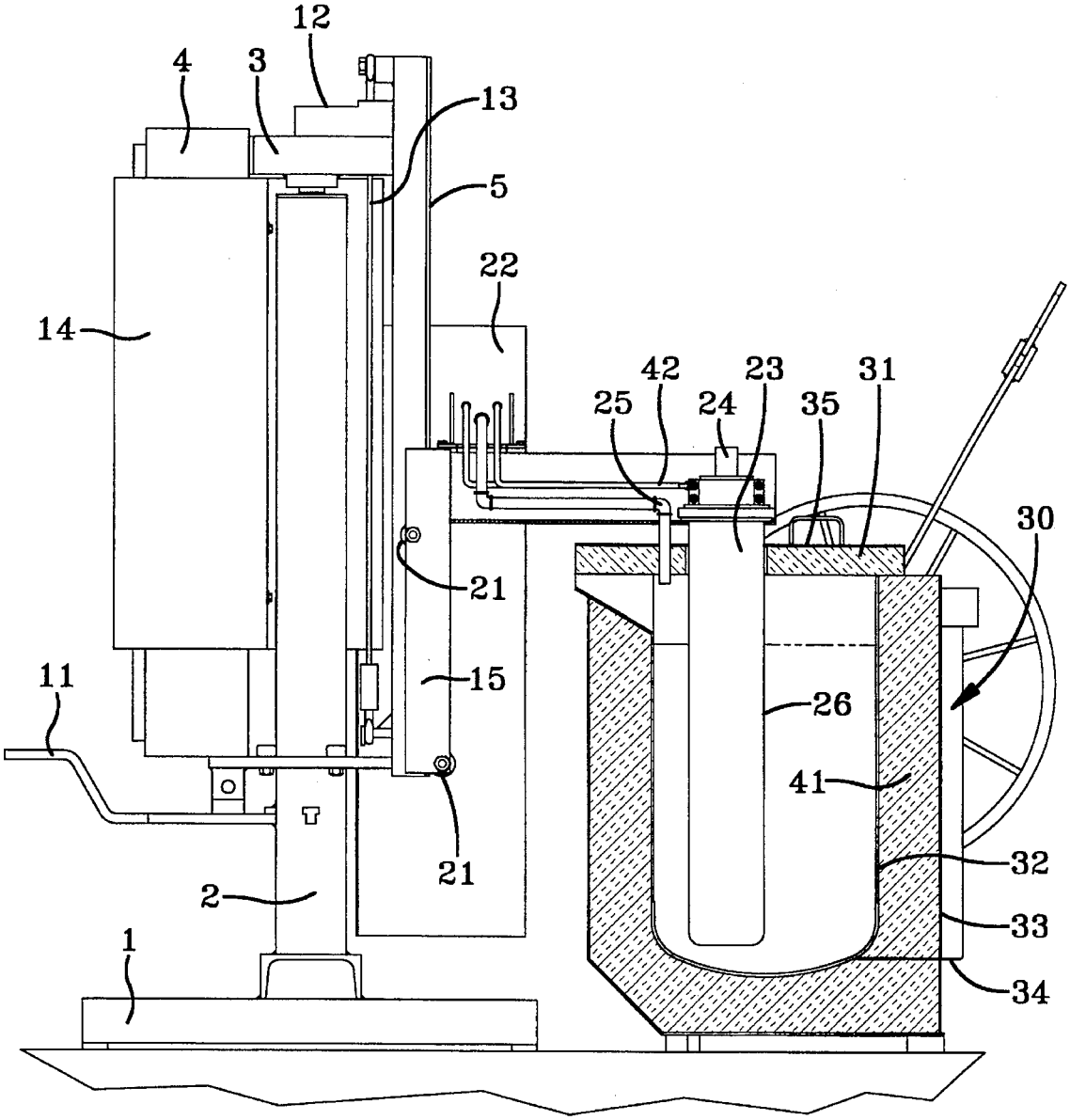
FIG. 1 is a side elevation of an apparatus according to the invention with the overarm support for the heating element and the ladle shown in section.
Figure 2:
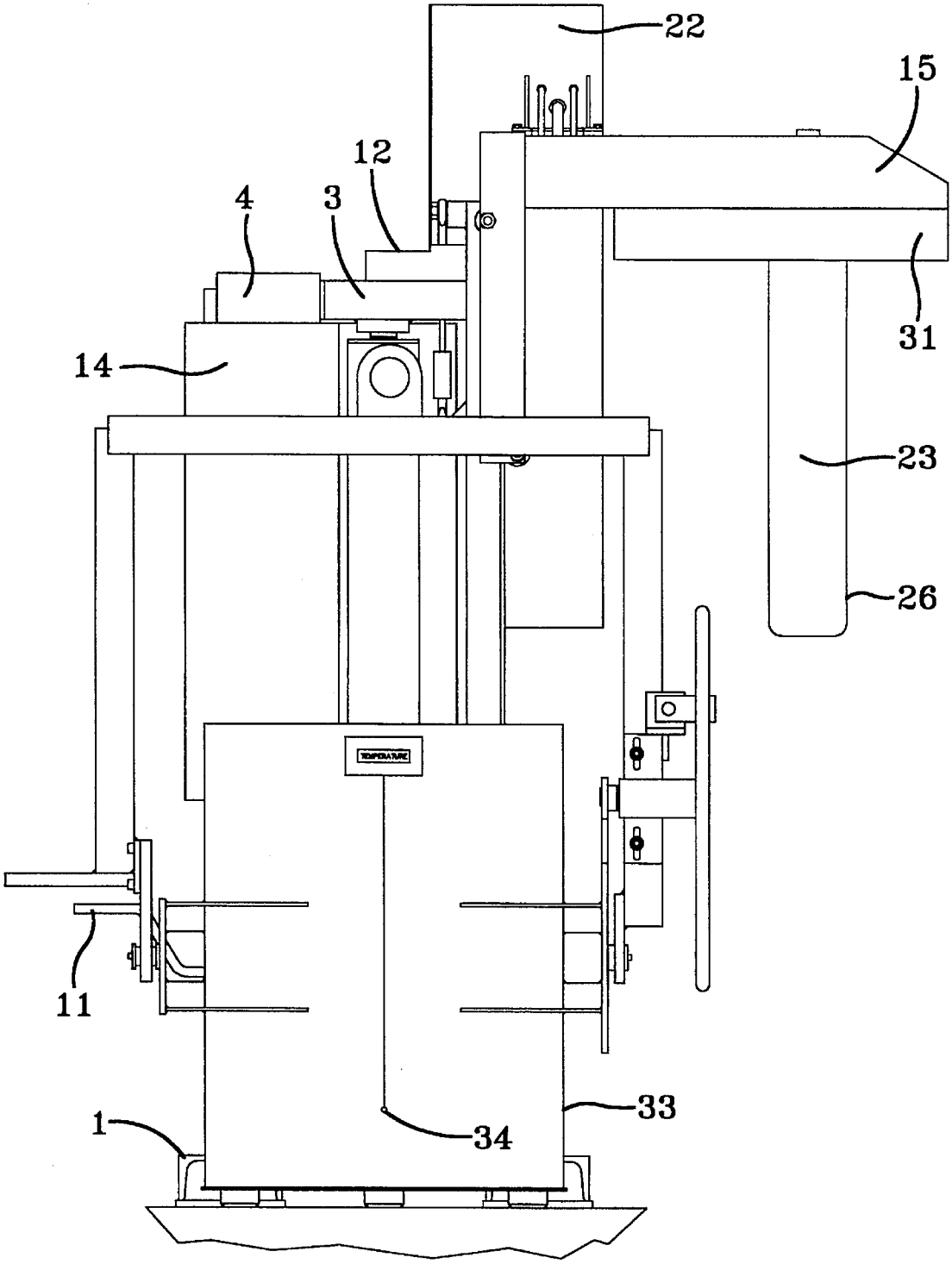
FIG. 2 is a view in front elevation of the apparatus of FIG. 1 but with the pivot frame rotated 90 degrees and the ladle in position to be picked up.
Figure 3:
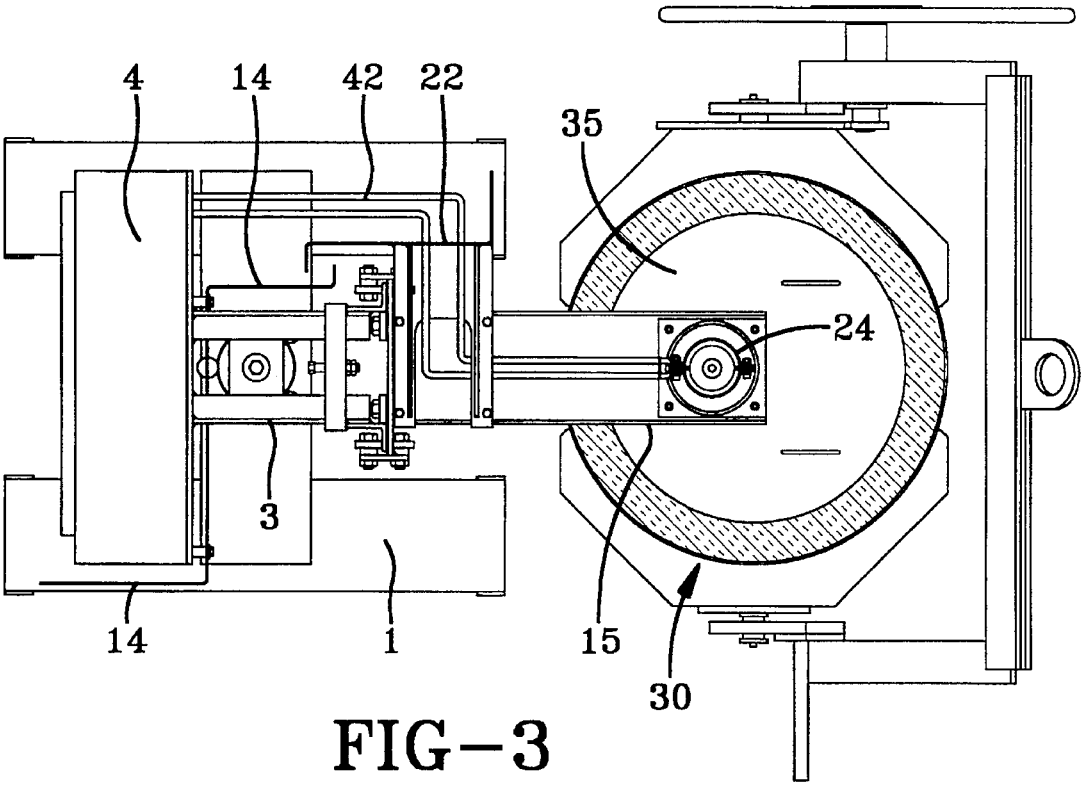
FIG. 3 is a plan view of the apparatus of FIG. 1 with the hoist removed for purposes of illustration.
Figure 4:
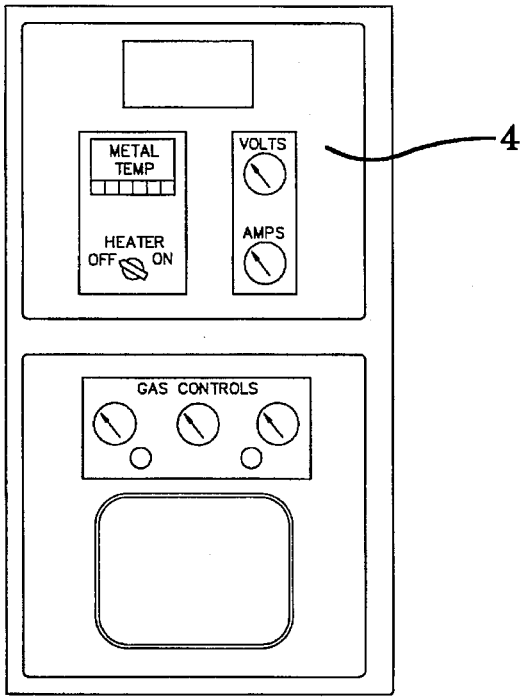
FIG. 4 is a side view in reduced scale of the apparatus of FIG. 1 showing only the face of the control panel.

Referring to the drawings in which like parts are referred to by like reference numerals, the apparatus of the invention is seen to be made up of an insulated ladle 30, shown in section, and resting next to a support means for an immersion heating element 23 that extends into the cavity of the ladle. The support means consists generally of a base 1 that supports a post 2 upon which is pivotally supported a frame 3. Upon the frame is a control panel 4, vertical guides 5, a radial locking handle 11, an electric hoist 12, a hoist cable 13, and a heat shield 14 for the components on the frame 3. The control panel 4 is seen only from the side in FIG. 1 behind the heat shield 14. The face of the control panel 4 with furnace temperature indicator, electrical resistance heater controls and controls for protective gas atmosphere is illustrated in FIG. 4.

A chain may be used instead of hoist cable 13. Instead of an electric hoist a hydraulic system may be used to raise and lower the traveling arm 15 carrying the heating element 23.

A vertical traveling arm 15 extending from the frame is guided by rollers 21 and the connecting wires 42 for the heating element 23 and hoses or pipes 25 providing a protective gas atmosphere are protected from radiant heat from the molten metal by a second heat shield 22. The heating element 23 is attached to the traveling arm 15 and electric power is supplied through cable 42 to an electric power connection 24. Melt shielding gases are preferably supplied over the melt through pipe 25. Pipe 25 is connected to a suitable source of an inert gas such as nitrogen in a cylinder of the compressed gas. The inert gas is preferably dry and free of pariculate matter. An insulation pad 31 is attached to the bottom face of a removable cover 35 supported by the vertical traveling arm 15. The insulated cover 35 may be formed of two semi-circular pieces of sheet metal that protect the insulative pad 31 from external physical damage.

The insulated cover 35 is removably positioned over the ladle 30 by the traveling arm 15as a protective cover during melting, helping to retain protective shielding gases. The ladle 30 consists of an inner hot face liner 32, and an outer shell 33 that is attached, either to a bail for overhead crane use or mounted on appropriate feet for fork truck handling. The ladle 30 may be mounted on rollers, slides, or other devices for handling purposes. Insulation 41 positioned between the inner hot face liner 32 and the outer shell 33 significantly reduces heat loss and protects the outer liner from any excessive heat. One or more temperature probes like probe 34 are extended through the outer shell 33 to provide metal temperature information to the operator and the power controller at the control panel 4.

The material used as the envelope or sleeve 26 of the heating element 23 and the hot face liner 32 will be selected to be appropriate for the metal being melted, for example, mild steel or high chromium-low carbon steel for melting magnesium or magnesium alloys and a refractory such as silicon carbide for aluminum or aluminum alloys. Other materials will be selected as known to be suitable for other non-ferrous metals such as copper, zinc, and lead and their alloys.

The heating element in most instances will preferably be an electric resistance heater that may be wire-wound or a resistance heater, and preferably a graphite type resistance heater that is positioned within a protective shell or sleeve such as sleeve 26. If desired, a gas burner type heater operated inside the sleeve may also be employed, although such a burner tends to produce contamination in the adjacent atmosphere by combustion products that are better avoided.

Using the heating element configuration of the present apparatus with the ladle well insulated the heat energy used is efficiently directed towards melting the non-ferrous metal or alloy. With the molten metal or alloy in the portable ladle unencumbered by heating elements and bulky, fragile insulation, the ladle is easy to handle during transport and casting steps. The apparatus is readily usable in a manner minimizing danger to the operator during the melting and casting steps.

In carrying out melting operations, the vertical traveling arm 15 with the heating element 23 suspended therefrom is moved to position the heating element 23 extending well into the ladle 30. Pieces of the metal or alloy to be melted are stacked inside the ladle around the heating element 23 and heating is commenced as by turning on the electric power to the electric resistance heaters while the flow of protective gas is commenced under the insulated cover 35. After the metal or alloy has melted and reached a preselected temperature appropriate for casting, the hoist 12 is operated to raise the heating element 23 out of the melt and the ladle 30 is hauled away by fork lift vehicle to the molds for casting the melt, or the traveling arm 15 is rotated out of the way and the ladle 30 is moved as by traveling crane to the mold or molds for the casting step.

In regular continued operations the ladle 30 is returned to a position beside the support for the heating element, often with a heel of remaining melt, whereupon the heating element 23 can be lowered into the heel and metal or alloy pieces again stacked around the heating element 23 and melting commenced.

I claim:

1. Apparatus for melting and casting a non-ferrous metal comprising:

a portable plural-walled ladle, a retractable immersion heating element, and support means for the immersion heating element capable of controllably lowering the immersion heating element so as to extend the immersion heating element a preselected depth into the ladle whereby the immersion heating element becomes immersed during melting operations, supporting the immersion heating element during melting operations, and raising the immersion heating element out of the ladle.

2. The apparatus of claim 1 wherein the apparatus further includes means for swinging the raised heating element away from the ladle.

3. The apparatus of claim 1 wherein the heating element is an electric resistance heating element.

4. The apparatus of claim 3 wherein the resistance heating element is a graphite electric resistance element.

5. A method for melting a non-ferrous metal in a portable plural-walled ladle comprising the steps of:

providing an assembly comprising a portable plural-walled ladle, a retractable immersion heating element, and support means for the immersion heating element capable of controllably lowering the immersion heating element so as to extend the immersion heating element a preselected depth into the ladle whereby the immersion heating element is immersed during melting operations, supporting the immersion heating element during melting operations, and raising the immersion heating element out of the ladle;

positioning the ladle adjacent the support means and lowering the immersion heating element into the ladle;

stacking a charge of metal or alloy to be melted in the ladle around the immersion heating element; and generating heat within the immersion heating element sufficient and for a sufficient time to melt the charge of metal or alloy and bring it to casting temperature.

6. The method of claim 5 including the additional steps of raising the heating element out of the melted metal or alloy and transfering the portable ladle to a mold or molds for casting operations.

* * * * *